US010900274B2

(12) United States Patent
Anderson, III et al.

(10) Patent No.: US 10,900,274 B2
(45) Date of Patent: Jan. 26, 2021

(54) ANTI-RATTLE ELEMENTS FOR INTERNAL DIVIDER OF GLASS ASSEMBLY

(71) Applicant: Pella Corporation, Pella, IA (US)

(72) Inventors: Howard C. Anderson, III, Tracy, IA (US); Paul Smith, Des Moines, IA (US)

(73) Assignee: Pella Corporation, Pella, IA (US)

( * ) Notice: Subject to any disclaimer, the term of this patent is extended or adjusted under 35 U.S.C. 154(b) by 26 days.

(21) Appl. No.: 15/694,285

(22) Filed: Sep. 1, 2017

(65) Prior Publication Data

US 2018/0066468 A1 Mar. 8, 2018

Related U.S. Application Data

(60) Provisional application No. 62/383,034, filed on Sep. 2, 2016.

(51) Int. Cl.
*E06B 3/663* (2006.01)
*E06B 3/66* (2006.01)

(52) U.S. Cl.
CPC ..... *E06B 3/6604* (2013.01); *E06B 3/6612* (2013.01)

(58) Field of Classification Search
CPC ..... E06B 3/6604; E06B 3/6612; E06B 3/24; E06B 3/62; E06B 3/64; E06B 3/66; E06B 3/5409
USPC ..... 52/204.6
See application file for complete search history.

(56) References Cited

U.S. PATENT DOCUMENTS

| | | | |
|---|---|---|---|
| 89,606 | A | 5/1869 | Strongfllow |
| 105,287 | A | 7/1870 | Wood |
| 262,530 | A | 8/1882 | Zacherl |
| 281,865 | A | 7/1883 | Goodwin |

(Continued)

FOREIGN PATENT DOCUMENTS

| | | | |
|---|---|---|---|
| CN | 101080542 | A | 11/2007 |
| CN | 101131061 | A | 2/2008 |

(Continued)

OTHER PUBLICATIONS

Lamatek. "Muntin Bumpers," [online], [retrieved on Mar. 15, 2018]. Retrieved from Lamatek using the Internet <http://www.lamatek.com/catalogs/fenestration/bumpers.shtml>, available at least as early as Sep. 1, 2015, 1 page.

*Primary Examiner* — Brian E Glessner
*Assistant Examiner* — James J Buckle, Jr.
(74) *Attorney, Agent, or Firm* — Faegre Drinker Biddle & Reath LLP

(57) ABSTRACT

An insulated glass assembly includes a first pane of translucent, obscure, or transparent sheet material, a second pane of translucent, obscure, or transparent sheet material spaced apart from the first pane, a perimeter spacer positioned between the first and second panes and extending around the perimeter of the panes, and an internal divider disposed between the first and second spaced apart panes. The internal divider is spaced from the first pane and second panes of sheet material to form a first gap and a second gap therebetween. The insulated glass assembly further includes a first spring element and a second element within the gaps between the internal divider and the first and second spaced apart panes. The first spring element and the second element combine to bias the internal divider against contact with either of the first and second spaced apart panes.

17 Claims, 5 Drawing Sheets

(56) References Cited

U.S. PATENT DOCUMENTS 327,858 A 10/1885 Bradford
426,792 A 4/1890 Foote
489,442 A 1/1893 Whetter
501,622 A 7/1893 Lee
685,466 A 10/1901 Bradshaw
718,007 A 1/1903 Linn
763,240 A 6/1904 Aupke
779,801 A 1/1905 Prden
798,369 A 8/1905 Stutenroth
798,544 A 8/1905 Van Horssen
812,097 A 2/1906 Stanley et al.
820,960 A 5/1906 Erb
820,961 A 5/1906 Erb
908,394 A 12/1908 Corbeille
928,526 A 7/1909 Loper
956,963 A 5/1910 Harmuth
984,669 A 2/1911 Hedstrom
1,082,663 A 12/1913 Viragh
1,134,203 A 4/1915 Jones
1,184,148 A 5/1916 Teisseire
1,193,211 A 8/1916 Webster
1,198,138 A 9/1916 Lovell
1,214,602 A 2/1917 Smith
1,220,675 A 3/1917 Parson
1,222,293 A 4/1917 Iman
1,282,490 A 10/1918 Sullwold
1,313,401 A 8/1919 Mann
1,325,790 A 12/1919 Kleinschmidt
1,327,441 A 1/1920 Mesker et al.
1,358,121 A 11/1920 Smith
1,361,913 A 12/1920 Sebastian
1,397,859 A 11/1921 Dickens
1,445,267 A 2/1923 Card
1,469,331 A 10/1923 Chester et al.
1,494,948 A 5/1924 Bujack
1,511,363 A 10/1924 Pierson
1,533,725 A 4/1925 Davenport
1,538,222 A 5/1925 Smith
1,601,773 A 10/1926 Sasgen
1,605,883 A 11/1926 Wheelock
1,644,814 A 10/1927 Barr
1,649,861 A 11/1927 Schneider
1,651,697 A 12/1927 Hadden
1,664,322 A 3/1928 Reese
1,694,886 A 12/1928 McClellan
1,707,888 A 4/1929 White
1,708,556 A 4/1929 Storms
1,835,558 A 12/1931 Campbell
1,899,466 A 2/1933 Kistner
1,988,810 A 1/1935 Ross
2,405,887 A 8/1946 Hoffman
2,788,098 A 4/1957 Bianco
3,157,224 A 11/1964 Spargur et al.
3,330,071 A 7/1967 Kubisiak
3,337,992 A 8/1967 Tolson
3,381,431 A 5/1968 Jacobson
3,456,387 A 7/1969 Tolson
4,113,905 A 9/1978 Kessler
4,377,969 A 3/1983 Nelson
4,416,101 A * 11/1983 Derner ..... E06B 3/66342 52/204.593
4,429,509 A * 2/1984 Vachet ..... E06B 3/66328 156/107
4,783,938 A * 11/1988 Palmer ..... E06B 3/6604 52/171.3
4,831,799 A * 5/1989 Glover ..... E06B 3/667 52/172
5,144,770 A 9/1992 Kraus et al.
5,313,761 A * 5/1994 Leopold ..... E06B 3/6675 52/456
5,494,715 A * 2/1996 Glover ..... B44F 1/063 156/107
5,502,925 A 4/1996 Gorrell
5,533,314 A * 7/1996 Kunert ..... B32B 3/10 156/109
5,553,420 A 9/1996 Klimek
5,568,702 A 10/1996 Frank et al.
5,568,703 A 10/1996 Frank et al.
5,615,522 A 4/1997 Tomanek
5,636,476 A 6/1997 Eikmeier et al.
5,640,828 A * 6/1997 Reeves ..... B29C 53/08 428/34
5,682,710 A 11/1997 Davies et al.
5,687,506 A 11/1997 Davies et al.
5,715,631 A 2/1998 Kailian et al.
5,775,028 A 7/1998 Lambert
5,826,377 A 10/1998 Simson et al.
5,839,229 A 11/1998 Briggs et al.
5,881,498 A 3/1999 Goggin et al.
5,937,582 A 8/1999 Taylor
5,946,857 A 9/1999 Davies et al.
6,161,336 A 12/2000 Ziv-Av
6,177,156 B1 * 1/2001 Glover ..... E06B 3/6604 428/207
6,209,269 B1 * 4/2001 Valderrama ..... E06B 3/24 52/171.3
6,209,364 B1 4/2001 Collet et al.
6,270,175 B1 8/2001 Sfeir
6,286,288 B1 * 9/2001 France ..... E06B 3/24 52/786.1
D453,214 S 1/2002 Komatsubara et al.
6,343,436 B1 2/2002 Milano et al.
6,354,639 B1 3/2002 Minter et al.
6,381,080 B1 4/2002 Holdener et al.
6,384,990 B1 5/2002 Holdener et al.
6,415,579 B1 * 7/2002 Reeder ..... E06B 1/006 52/204.6
6,425,221 B1 7/2002 Reichert
6,431,620 B2 8/2002 Tremblay et al.
6,442,898 B1 9/2002 Wu
6,484,445 B2 11/2002 Chang
6,536,182 B2 * 3/2003 France ..... E06B 3/24 428/34
6,546,671 B2 4/2003 Mitchell et al.
6,619,707 B2 9/2003 Sucu et al.
6,684,474 B2 2/2004 Reichert
6,817,142 B2 11/2004 Marshik
6,868,596 B2 3/2005 Reichert
6,871,884 B2 3/2005 Hoffmann et al.
6,871,885 B2 3/2005 Goldenberg et al.
6,915,608 B2 7/2005 Labarre
6,926,363 B2 8/2005 Yamashita
6,968,646 B2 11/2005 Goldenberg et al.
7,013,603 B2 3/2006 Eenigenburg et al.
7,017,301 B2 3/2006 Balbo Di Vinadio
7,024,821 B2 4/2006 Lu
7,036,274 B2 5/2006 Carrier
7,048,312 B2 5/2006 Brunner
7,100,327 B2 9/2006 Rangabasyam et al.
7,147,255 B2 12/2006 Goldenberg et al.
7,159,908 B2 1/2007 Liang
7,216,401 B2 5/2007 Bae
7,246,411 B2 7/2007 Campbell et al.
7,246,840 B2 7/2007 Gates et al.
7,257,864 B2 8/2007 Liang et al.
7,270,859 B2 * 9/2007 Acevedo ..... E06B 3/24 428/34
D558,024 S 12/2007 Tremble et al.
7,305,800 B1 12/2007 Calfee
D559,078 S 1/2008 Baczuk et al.
D560,112 S 1/2008 Baczuk et al.
7,325,359 B2 2/2008 Vetter
7,396,054 B2 7/2008 Carrier
7,412,800 B2 8/2008 Maier
7,464,619 B2 12/2008 Vetter
7,614,184 B2 11/2009 Rebel et al.
7,743,570 B2 * 6/2010 Reichert ..... E06B 3/6604 428/34
7,913,456 B2 3/2011 Balbo Di Vinadio
7,963,577 B2 6/2011 Wolf
7,971,392 B2 7/2011 Seo

(56) References Cited

U.S. PATENT DOCUMENTS 8,046,954 B2 11/2011 Curtis et al.
8,051,604 B2 11/2011 Diekmann et al.
8,087,322 B1 1/2012 Morris
8,156,612 B2 4/2012 Yamashita
8,171,673 B2 5/2012 Helms
8,182,001 B2 5/2012 Tremble et al.
8,281,458 B2 10/2012 Balbo Di Vinadio
8,308,204 B2 11/2012 Lindgren et al.
8,336,930 B2 12/2012 Liang et al.
8,448,996 B2 5/2013 Lake et al.
8,474,186 B2 7/2013 Dufour et al.
8,490,330 B2 7/2013 Lund et al.
8,511,724 B2 8/2013 Liang et al.
8,602,463 B2 12/2013 Keighley et al.
8,657,347 B2 2/2014 Liang et al.
8,683,746 B2 4/2014 Lambertini
8,707,621 B2 4/2014 Curtis et al.
8,727,395 B2 5/2014 Nania
8,733,021 B2 5/2014 Lambertini
8,769,872 B2 7/2014 Maltaverne et al.
8,789,857 B2 7/2014 Liang et al.
D712,280 S 9/2014 Radomyselski et al.
8,899,632 B2 12/2014 Tremble et al.
8,919,699 B2 12/2014 Kress et al.
8,925,150 B2 1/2015 Pacini
8,935,887 B2 1/2015 Cavalcante
9,163,437 B1 10/2015 Lawrence
9,234,374 B2 1/2016 Wolf et al.
9,273,763 B2 3/2016 Evensen
9,441,714 B2 9/2016 Hsu et al.
D795,848 S 8/2017 Zheng et al.
9,745,784 B1 8/2017 Lawrence
9,759,001 B2 9/2017 Bisang et al.
9,772,010 B2 9/2017 Dodge et al.
D808,256 S 1/2018 Muller
9,889,725 B2 2/2018 Boesel et al.
2001/0019211 A1 9/2001 Tremblay et al.
2001/0034990 A1 11/2001 Reichert
2002/0046545 A1 4/2002 France
2002/0050115 A1 5/2002 Reeder et al.
2002/0116874 A1 8/2002 Marshik
2002/0119000 A1 8/2002 Gledhill
2002/0124468 A1 9/2002 Manzella
2002/0144465 A1 10/2002 Chang
2002/0145291 A1 10/2002 Goldenberg et al.
2002/0162223 A1 11/2002 Reichert
2002/0167180 A1 11/2002 Sucu et al.
2003/0014920 A1 1/2003 Lu
2003/0024168 A1 2/2003 Mitchell et al.
2003/0047949 A1 3/2003 Brunner
2003/0079414 A1 5/2003 Rangabasyam et al.
2003/0110699 A1 6/2003 Eenigenburg et al.
2003/0110701 A1 6/2003 Dawson
2003/0159477 A1 8/2003 Hoffmann et al.
2003/0172591 A1 9/2003 Labarre
2004/0036299 A1 2/2004 Goldenberg et al.
2004/0036300 A1 2/2004 Goldenberg et al.
2004/0076815 A1* 4/2004 Reichert ..... E06B 3/6604 428/317.1
2004/0128914 A1 7/2004 Hempelmann
2004/0154248 A1 8/2004 Reichert
2004/0216381 A1 11/2004 Clavet
2004/0216541 A1 11/2004 Vetter
2004/0245801 A1 12/2004 Gates et al.
2004/0258859 A1 12/2004 Acevedo et al.
2004/0261320 A1 12/2004 Sullivan
2005/0011049 A1 1/2005 Muir
2005/0022941 A1 2/2005 Di Vinadio
2005/0046260 A1 3/2005 Yamashita
2005/0055804 A1 3/2005 Liang et al.
2005/0072075 A1 4/2005 Maier
2005/0078818 A1 4/2005 Bae
2005/0132532 A1 6/2005 Campbell et al.
2005/0262769 A1 12/2005 Vetter
2006/0032143 A1 2/2006 Johnson
2006/0053692 A1 3/2006 Rebel et al.
2006/0087130 A1 4/2006 Liang
2006/0191215 A1* 8/2006 Stark ..... C03C 27/08 52/204.6
2006/0218864 A1 10/2006 Blomqvist
2006/0244269 A1 11/2006 Rotondi
2007/0020091 A1 1/2007 Giaimo et al.
2007/0020092 A1 1/2007 Giaimo et al.
2007/0040396 A1 2/2007 Carrier
2007/0137110 A1 6/2007 Liles, Jr.
2007/0158953 A1 7/2007 Liang
2008/0000164 A1 1/2008 Erickson et al.
2008/0001413 A1 1/2008 Lake et al.
2008/0040978 A1 2/2008 Diekmann et al.
2008/0092446 A1 4/2008 Bienek
2008/0120915 A1 5/2008 Flores
2008/0129054 A1 6/2008 Tremble et al.
2008/0178424 A1 7/2008 Tuller
2008/0229667 A1 9/2008 Dufour et al.
2008/0250719 A1 10/2008 Griffin et al.
2008/0256874 A1 10/2008 Curtis et al.
2009/0013605 A1 1/2009 Seo
2009/0025301 A1 1/2009 Di Vinadio
2009/0079202 A1 3/2009 Wolf
2009/0139165 A1 6/2009 Prete et al.
2009/0146436 A1 6/2009 Lindgren et al.
2010/0050524 A1 3/2010 Helms
2010/0089190 A1 4/2010 Busch
2010/0139039 A1 6/2010 Balbo Di Vinadio
2010/0146883 A1* 6/2010 Benkel ..... E06B 3/6675 52/204.64
2010/0192643 A1 8/2010 Liang et al.
2010/0276947 A1 11/2010 Keighley et al.
2010/0293748 A1 11/2010 Yamashita
2011/0062727 A1 3/2011 Liang et al.
2011/0068124 A1 3/2011 Reynolds et al.
2011/0298225 A1 12/2011 Liang et al.
2012/0023826 A1 2/2012 Curtis et al.
2012/0068478 A1 3/2012 Nania
2012/0167469 A1 7/2012 Maltaverne et al.
2012/0174487 A1 7/2012 Lambertini
2012/0180392 A1 7/2012 Lambertini
2012/0297683 A1 11/2012 Cavalcante
2012/0313387 A1 12/2012 Liang et al.
2013/0104458 A1 5/2013 Leung et al.
2013/0111819 A1 5/2013 Tremble et al.
2013/0214545 A1 8/2013 Wolf et al.
2013/0220043 A1 8/2013 Hsu et al.
2013/0256458 A1 10/2013 Kress et al.
2014/0007378 A1 1/2014 Pacini
2014/0007720 A1 1/2014 Evensen
2014/0259940 A1 9/2014 Meves et al.
2015/0114176 A1 4/2015 Bisang et al.
2016/0145911 A1 5/2016 Boesel et al.
2017/0107750 A1 4/2017 Carrier
2020/0131832 A1 4/2020 Bernhagen et al.

FOREIGN PATENT DOCUMENTS

DE 20316561 U1 1/2004
DE 102007002650 A1 7/2008
DE 102009007686 A1 4/2010
DE 102010000158 A1 9/2010
EP 0740041 A1 10/1996
EP 0857847 B1 8/1998
EP 1092829 A2 4/2001
EP 1241311 A2 9/2002
EP 1505242 A1 2/2005
EP 2735677 A1 5/2014
GB 2475507 A 5/2011
GB 2520340 A 5/2015

* cited by examiner

ANTI-RATTLE ELEMENTS FOR INTERNAL DIVIDER OF GLASS ASSEMBLY

CROSS REFERENCE TO RELATED APPLICATION

The present application claims benefit to Provisional Patent Application Ser. No. 62/383,034, filed on Sep. 2, 2016 and titled ANTI-RATTLE ELEMENTS FOR INTERNAL DIVIDER OF GLASS ASSEMBLY, the entire disclosure of which is hereby incorporated by reference herein.

TECHNICAL FIELD

The present invention relates to windows and doors for use in buildings.

BACKGROUND

A true divided light window or door is very attractive and popular for use in homes, but is very expensive as individual panes of glass must be assembled into an insulated glass assembly for a window or door. Alternatively, external grids may simplify window or door construction, but are difficult to clean and may be fragile if a thin grid design is used.

Internal grids of muntin bars may be positioned between the spaced apart panes of glass of an insulated glass assembly. In contrast to external grids, internal grids may not collect dust or dirt and allow the panes of glass to be readily cleaned. However, the use of internal grids may also cause other issues. For example, the use of internal metal muntin bars may cause heat loss through the metal bars. In addition, spacers to constrain muntin bars between panes of glass can produce stress points in glass, and during very cold weather, breakage has occurred as the panes contracted towards each other. Undesirable rattling may also occur with internal grids from contact between the muntin bars and panes, for example, during high winds.

SUMMARY

As described herein, spring elements may be positioned between panes of an insulated glass assembly and an internal divider disposed between the panes. The spring elements may bias the internal divider against contact with either of the first and second spaced apart panes.

In one example, this disclosure is directed to an insulated glass assembly includes a first pane of translucent, obscure, or transparent sheet material, a second pane of translucent, obscure, or transparent sheet material spaced apart from the first pane of sheet material, a perimeter spacer positioned between the first and second panes and extending around the perimeter of the panes and defining two pairs of opposite sides of the glass assembly, and an internal divider disposed between the first and second spaced apart panes. The internal divider is spaced from the first pane of sheet material to form a first gap therebetween, and the internal divider is spaced from the second pane of sheet material to form a second gap therebetween. The insulated glass assembly further includes a first spring element within the first gap between the internal divider and the first pane of sheet material, and a second element within the second gap between the internal divider and the second pane of sheet material. The first spring element and the second element combine to bias the internal divider against contact with either of the first and second spaced apart panes.

While multiple examples are disclosed, still other examples of the present disclosure will become apparent to those skilled in the art from the following detailed description, which shows and describes illustrative examples of this disclosure. Accordingly, the drawings and detailed description are to be regarded as illustrative in nature and not restrictive.

DETAILED DESCRIPTION

Figure 1A:
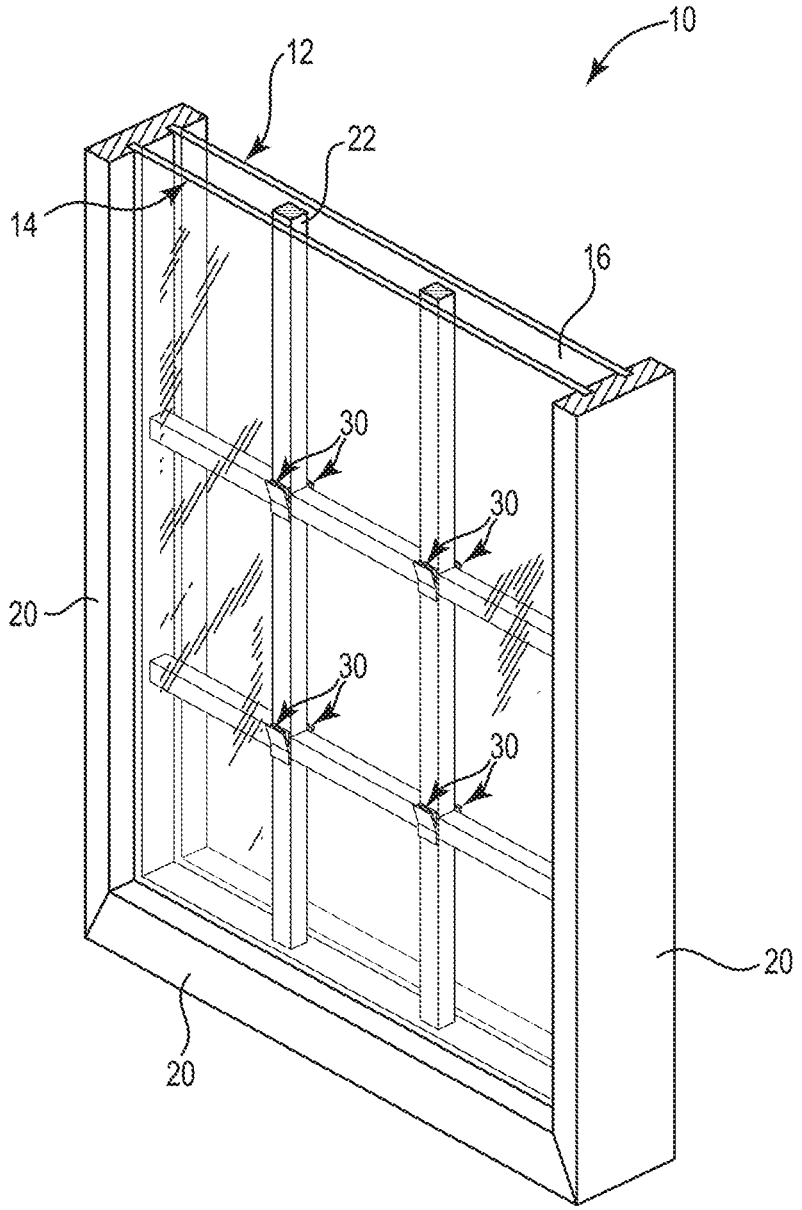
FIGS. 1A-1C illustrate components of an insulated glass assembly including spring elements between a grill and glass panes.

FIG. 1A illustrate a cut-away view of insulated glass assembly 10, which is a component of a window, such as a component of a window sash, or a component of a door. Insulated glass assembly 10 includes a first pane 12 of translucent, obscure, or transparent sheet material, a second pane 14 of translucent, obscure, or transparent sheet material, the second pane 14 of sheet material being spaced apart from the first pane 12 of sheet material to form a gap 16 there between, and a perimeter spacer 20 positioned between the first and second panes 12, 14 and extending around the perimeter of the panes 12, 14.

Insulated glass assembly 10 further includes an internal divider 22 disposed between the first and second spaced apart panes 12, 14 within gap 16. In various examples, the internal divider 22 may include a bar, a hollow, a rod, a channel, a solid shape, a grill between glass (GBG), a simulated divided light (SDL) spacer tube, and a shade bar. The internal divider 22 is spaced from the first pane 12 to form a first gap therebetween, and is spaced from the second pane 14 to form a second gap therebetween.

Spring elements 30 are located within the first gap between the internal divider 22 and the first pane 12 and within the second gap between the internal divider 22 and the second pane 14. In the example of FIG. 1A, spring elements 30 are positioned on either side of intersections of vertical and horizontal elements of internal divider 22. Such an arrangement may provide suitable support for internal divider 22 while limiting the visual perceptibility of spring elements 30, although other arrangements of spring elements and internal divider 22 may also be used. Spring elements 30 may be formed from a transparent material to reduce their visual perceptibility. In the same or different examples, spring elements 30 also may be formed from an outgassing resistant material to reduce their impact on the internal environment of insulated glass assembly.

Internal divider 22 may be formed from a material low in thermal conductivity, such as a foam material to limit heat transfer between panes 12, 14. Likewise, spring elements 30 may be formed from low thermal conductivity materials, such as a polymeric material to limit heat transfer between panes 12, 14. In addition contact surface area between spring elements 30 and panes 12, 14 may be limited to further mitigate heat transfer between panes 12, 14.

Figure 1B:
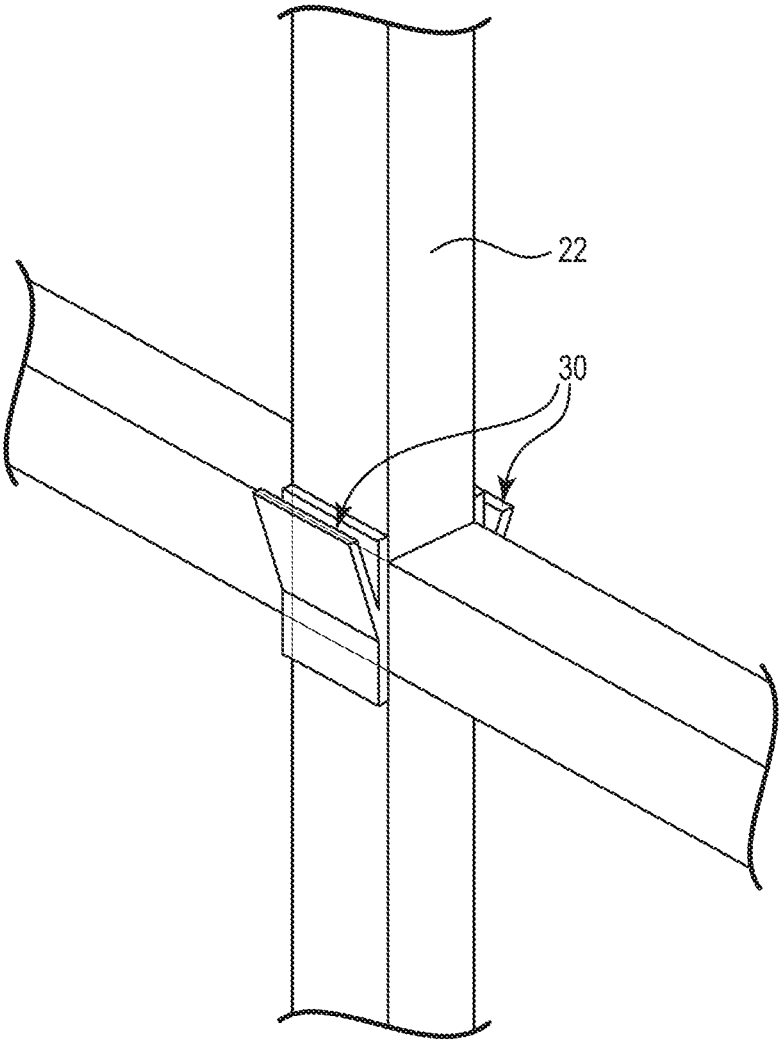

FIG. 1B illustrates internal divider 22 and a single spring element 30, which is representative of one or more of spring elements 30 of FIG. 1A. As shown in FIG. 1B, spring element 30 is a flexible, clear material folded to create a leaf spring is adhered on the internal divider 22.

Figure 1C:
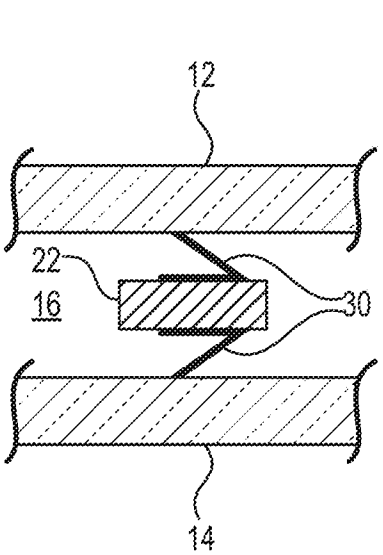

FIG. 1C illustrates a close-up view of a single set of spring elements 30A, 30B, which are representative of one or more of spring elements 30 of FIG. 1A. Spring elements 30A, 30B space internal divider 22 within gap 16 between panes 12, 14. The first spring element 30A and the second spring element 30B combine to bias the internal divider 22 against contact with either of the first pane of sheet material 12 or the second pane of sheet material 14.

The pair of spring elements 30A, 30B are on opposite sides of internal divider 22, and the height of a spring element 30 may be sufficient to touch the adjacent pane. The pair of spring elements 30A, 30B may bias the internal divider 22 against contact with either of the adjacent panes 12, 14. The pair of spring elements 30A, 30B are on opposite sides of internal divider 22 and may function to keep internal divider 22 approximately centered within gap 16 between panes 11, 12. The pair of spring elements 30A, 30B may also prevent internal divider 22 from hitting either of the first and second spaced apart panes, 11, 12, when the panes 11, 12 and/or internal divider 22 vibrate, due to wind, or other agitation such as an external impact. The pair of spring elements 30A, 30B may prevent also internal divider 22 from hitting either of the first and second spaced apart panes, 11, 12, from hitting either of the first and second spaced apart panes, 11, 12, when insulated glass assembly 10 experiences fluctuations in gap 16 between the first and second spaced apart panes due to changing environmental conditions.

Spring elements 30 each represent a leaf spring that elastically deforms when compressed. In the example depicted in FIGS. 1A-1C, the leaf spring includes a bent polymeric sheet material, with one side of the sheet material secured to the internal divider 22.

In other examples, one of spring elements 30 may be replace with a bumper. In such examples, the bumper may maintain a spacing between internal divider 22 and the adjacent one of panes 12, 14. A spring element 30 may maintain a spacing between internal divider 22 and the other one of panes 12, 14. In such examples, the single spring element 30 may allow changing spacing between panes 12, 14, e.g., due to vibrations or changing environmental conditions, whereas the bumper simply maintains a less adaptable spacing between internal divider 22 and the adjacent one of panes 12, 14. In this manner, spring elements 30 on only a single side of internal divider 22 may combine with less flexible bumpers to maintain spacing between internal divider 22 and panes 12, 14 while also limiting stress concentrations due to changing spacing between panes 12, 14.

FIGS. 2A-2H illustrate alternative leaf spring elements between a pane and a bar. The leaf spring elements of FIGS. 2A-2H may be used in place of spring elements 30 as described with respect to FIGS. 1A-1C. In various examples different spring element configurations may be used for the spring elements within a single glass assembly 10 or the same spring element configuration be used for each of the spring elements within a single glass assembly 10.

Figure 2A:
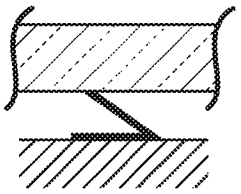
FIGS. 2A-2H illustrate alternative spring elements to those of FIGS. 1A-1C.

In the example, of FIG. 2A the leaf spring element is the same spring elements 30 as depicted in FIGS. 1A-1C. The leaf spring element of FIG. 2A includes a folded polymeric sheet material, with one side of the sheet material secured to the internal divider 22. Similarly, the leaf spring element of FIG. 2B includes a folded sheet material, with one side of the sheet material secured to the internal divider 22, but the free side of the folded polymeric sheet material is curved such that a convex surface of the spring element contacts the pane. The leaf spring element of FIG. 2C includes a twice-folded sheet material to form a Z-shape, with one side of the sheet material secured to the internal divider 22 and the other parallel side of the Z-shape in contact with the pane.

Figure 2B:
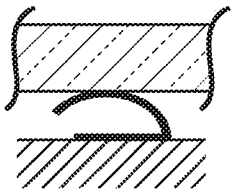
Figure 2C:
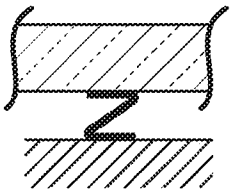
Figure 2D:
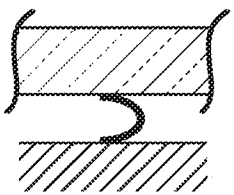
Figure 2E:
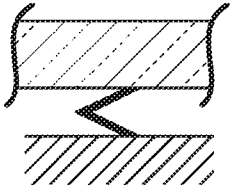

The leaf spring element of FIG. 2D includes a twice-folded sheet material to form a M-shape, with one side of the sheet material secured to the internal divider 22 and the other parallel side of the M-shape in contact with the pane. The center of the M-shape provides a continuous curve configuration. Similarly, the leaf spring element of FIG. 2E includes a 3-fold sheet material to form a M-shape, with one side of the sheet material secured to the internal divider 22 and the other parallel side of the M-shape in contact with the pane. In contrast with the leaf spring element of FIG. 2D, the center of the M-shape of the leaf spring element of FIG. 2E includes a distinct fold.

Figure 2F:
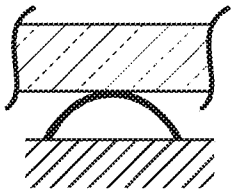
Figure 2G:
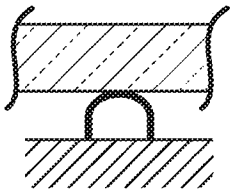
Figure 2H:
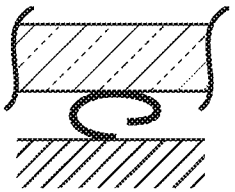

The leaf spring element of FIG. 2F forms a C-shape, with the ends of the sheet material secured to the internal divider 22 and the curved side of the C-shape in contact with the pane. Similarly, the leaf spring element of FIG. 2G forms an extended C-shape, with the ends of the sheet material secured to the internal divider 22 and extending about perpendicular to the internal divider 22 with the curved side of the C-shape in contact with the pane. In an alternative configuration, the leaf spring element of FIG. 2H forms a C-shape, with the ends of the sheet material pointing towards one another and secured to the internal divider 22 and extending about perpendicular to the internal divider 22 and the curved side of the C-shape in contact with the pane.

While the examples of 2A-2H are each described as being secured to the internal divider 22, in other examples, such leaf spring element configurations may be adhered to the pane or simply compressed between the internal divider 22 and the pane to maintain their positions within an insulated glass assembly. In the same or different examples, internal divider 22 may include complimentary features, such as snap fit elements, to engage a leaf spring element such that active adhesion techniques are not required.

Figure 3:
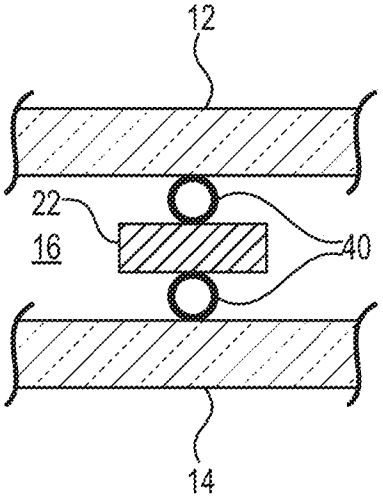
FIG. 3 is a close-up view of a single set of spring elements within an insulated glass assembly having a tubular design.

FIG. 3 is a close-up view of a single set of spring elements 40 within a window sash. As shown spring elements 40 are have a tubular design formed from a tubular, flexible material. Spring elements 40 may be used in place of one or more of spring elements 30 of FIG. 1A to space internal divider 22 within gap 16 between panes 12, 14. Spring elements 40 combine to bias the internal divider 22 against contact with either of the first pane of sheet material 12 or the second pane of sheet material 14.

The height of a spring element 40 may be sufficient to touch the adjacent pane 12 or pane 14 and bias the internal divider 22 against contact with the adjacent pane. The pair of spring elements 40 are on opposite sides of internal divider 22 and may function in the manner described with respect to spring elements 30 to keep internal divider 22 approximately centered within gap 16 between panes 11, 12 and prevent internal divider 22 from hitting either of the first and second spaced apart panes, 11, 12. Spring elements 40 each represent a tubular spring element that elastically deforms when compressed.

FIGS. 4A-4H illustrate alternative spring elements formed from a tubular, flexible material similar to that of FIG. 3. The spring elements of FIGS. 4A-4H may be used in place of leaf spring elements 30 as described with respect to FIGS. 1A-1C. In various examples different spring element configurations may be used for the spring elements within a single glass assembly 10 or the same spring element configuration be used for each of the spring elements within a single glass assembly 10.

Figure 4A:
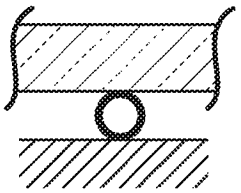
FIGS. 4A-4H illustrate alternative spring elements to those of FIG. 3.
Figure 4B:
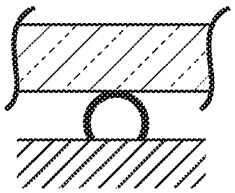
Figure 4C:
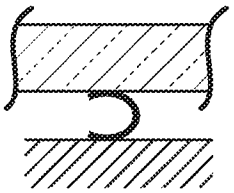

In the example of FIG. 4A, the spring element is the same spring elements 40 as depicted in FIG. 3. The spring element of FIG. 4A includes a tubular, flexible material, such as a polymeric material, and one side of the tubular material may be secured to the internal divider 22.

The spring element of FIG. 2B includes a cut tubular material, with one side of the material secured to the internal divider 22, but the free side of the cut tubular material is curved such that a convex surface of the spring element contacts the pane. The spring element of FIG. 4C also includes a cut tubular material, with the cut side facing away from both the pane and the internal divider 22 rather than towards the internal divider 22 as with the spring element of FIG. 4B.

Figure 4D:
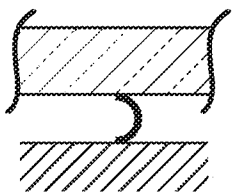

In the example of FIG. 4D, the spring element includes about half of a longitudinally bisected tubular material, although in other examples more or less than half of a longitudinally split tubular material may be used instead.

Figure 4E:
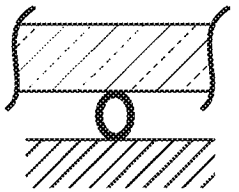
Figure 4F:
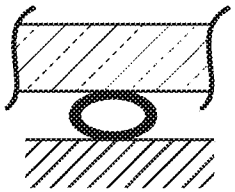

In the examples of FIGS. 4E and 4F, the spring element includes an oblong tubular material, with the major axis of the oblong tubular material being oriented about perpendicularly to the pane in the example of FIG. 4E and about parallel to the pane in the example FIG. 4F.

Figure 4G:
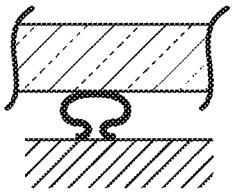

In the example of FIG. 4G, the spring element includes a cut tubular material with the ends of the cut material bent outwardly and secured to the internal divider 22.

Figure 4H:
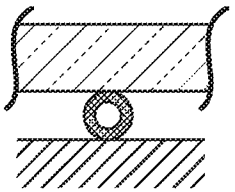

In the example of FIG. 4H, the spring element includes a tubular material of thicker construction than that previously depicted. The thickness of the tubular material may be selected in combination with the material of the spring element to provide a desired level of spring force.

While the examples of 4A-4H are each described as being secured to the internal divider 22, in other examples, such configurations may be adhered to the pane or simply compressed between the internal divider 22 and the pane to maintain their positions within an insulated glass assembly. In the same or different examples, internal divider 22 may include complimentary features, such as snap fit elements, to engage a spring element such that active adhesion techniques are not required.

Figure 5:
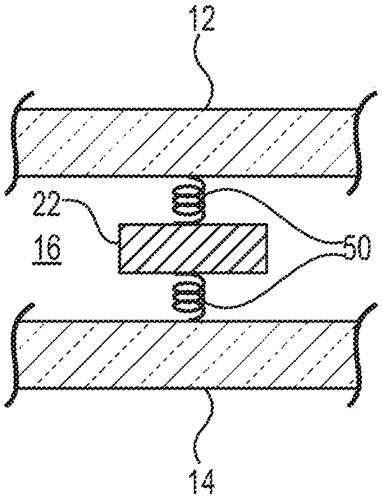
FIG. 5 is a close-up view of a single set of spring elements within an insulated glass assembly having a coil design.

FIG. 5 is a close-up view of a single set of spring elements 50 within a window sash. As shown spring elements 50 having a coiled construction, such as a helical coil. Spring elements 50 may be used in place of one or more of spring elements 30 of FIG. 1A to space internal divider 22 within gap 16 between panes 12, 14. Spring elements 50 combine to bias the internal divider 22 against contact with either of the first pane of sheet material 12 or the second pane of sheet material 14.

The height of a spring element 50 may be sufficient to touch the adjacent pane 12 or pane 14 and bias the internal divider 22 against contact with the adjacent pane. The pair of spring elements 50 are on opposite sides of internal divider 22 and may function in the manner described with respect to spring elements 30 to keep internal divider 22 approximately centered within gap 16 between panes 11, 12 and prevent internal divider 22 from hitting either of the first and second spaced apart panes, 11, 12. Spring elements 50 each represent a coil spring element that elastically deforms when compressed.

Figure 6C:
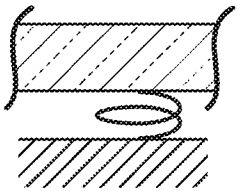
FIGS. 6A-6C illustrate alternative spring elements to those of FIG. 5.
Figure 6B:
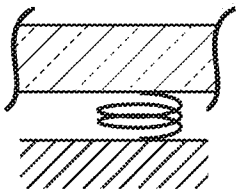
Figure 6A:
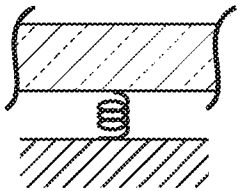

FIGS. 6A-6C illustrate alternative spring elements formed from coil similar to that of FIG. 5. The spring elements of FIGS. 6A-6C may be used in place of leaf spring elements 30 as described with respect to FIGS. 1A-1C. In various examples different spring element configurations may be used for the spring elements within a single glass assembly 10 or the same spring element configuration be used for each of the spring elements within a single glass assembly 10.

In the example of FIG. 6A, the spring element is the same spring elements 50 as depicted in FIG. 3. The spring element of FIG. 6A includes coil of a diameter that is smaller than the distance between the pane and the internal divider 22. In contrast, the spring element of FIG. 6B includes coil of a diameter that is larger than the distance between the pane and the internal divider 22. The spring element of FIG. 6B includes coil of a diameter that about equal to the distance between the pane and the internal divider 22.

Internal divider 22 may include complimentary features, such as snap fit elements, to engage a spring element such that active adhesion techniques are not required. Alternatively, the spring elements of FIGS. 6A-6C may be adhered to internal divider 22 or simply compressed between the pane and internal divider 22.

While multiple examples are disclosed, still other examples within the scope of the present disclosure will become apparent to those skilled in the art from the detailed description provided herein, which shows and describes illustrative examples. Accordingly, the drawings and detailed description are to be regarded as illustrative in nature and not restrictive. Features and modifications of the various examples are discussed herein and shown in the drawings. While multiple examples are disclosed, still other examples of the present disclosure will become apparent to those skilled in the art from the following detailed description, which shows and describes illustrative examples of this disclosure.

What is claimed is:

1. An insulated glass assembly comprising:

a first pane of translucent, obscure, or transparent sheet material and having a perimeter extending around a central region;

a second pane of translucent, obscure, or transparent sheet material spaced apart from the first pane of sheet material and having a perimeter extending around a central region;

a perimeter spacer positioned between the first and second panes and extending around the perimeters of the panes and defining two pairs of opposite sides of the glass assembly;

an internal divider extending across the central regions of the panes, the internal divider having a first face and a second face opposite the first face, the internal divider being distinct from the perimeter spacer and being disposed between the first and second spaced apart panes, wherein the internal divider is spaced from the first pane of sheet material with the first face oriented toward the first pane of sheet material to form a first gap therebetween, and the internal divider is spaced from the second pane of sheet material with the second face oriented toward the second pane of sheet material to form a second gap therebetween;

a first spring element configured as a leaf spring extending from the second face of the internal divider within the first gap between the internal divider and the first pane of sheet material, the first spring element being in a compressed state between the first face of the internal divider and the first pane of sheet material to bias the internal divider away from the first pane of sheet material; and a second spring element configured as a leaf spring extending from the first face of the internal divider within the second gap between the internal divider and the second pane of sheet material, the second spring element being in a compressed state between the second face of the internal divider and the second pane of sheet material to bias the internal divider away from the second pane of sheet material, such that the first spring element and the second spring element combine to bias the internal divider against contact with either of the first and second spaced apart panes, wherein the first spring element has a leaf spring configuration selected from the following:

a folded polymeric sheet material, with one side of the sheet material secured to the internal divider;

a folded sheet material, with one side of the sheet material secured to the internal divider, with the free side of the folded sheet material being curved such that a convex surface of the spring element contacts the first pane;

a twice-folded sheet material forming a Z-shape, with one side of the sheet material secured to the internal divider and a parallel side of the Z-shape in contact with the first pane;

a twice-folded sheet material forming an M-shape, with one side of the sheet material secured to the internal divider and a parallel side of the M-shape in contact with the first pane, such that the center of the M-shape provides a continuous curve;

a 3-fold sheet material forming an M-shape, with one side of the sheet material secured to the internal divider and the other parallel side of the M-shape in contact with the first pane, such that a center of the M-shape of the leaf spring element includes a distinct fold;

a sheet of material forming a C-shape, with opposing ends of the sheet material secured to the internal divider and a curved side of the C-shape in contact with the first pane;

a sheet of material forming an extended C-shape, with opposing ends of the sheet material secured to the internal divider and extending about perpendicular to the internal divider with a curved side of the C-shape in contact with the first pane; or a sheet of material forming a C-shape, with opposing ends of the sheet material pointing toward one another and secured to the internal divider and extending about perpendicular to the internal divider with the curved side of the C-shape in contact with the first pane.

2. The insulated glass assembly of claim 1, wherein the internal divider includes at least one of:

a bar;

a hollow;

a rod;

a channel;

a solid shape;

a grill between glass (GBG);

a simulated divided light (SDL) spacer tube; and a shade bar.

3. The insulated glass assembly of claim 1, wherein the first spring element and the second spring element combine to bias the internal divider to be about centered between the first and second spaced apart panes.

4. The insulated glass assembly of claim 1, wherein the first spring element and the second spring element are configured to prevent the internal divider from contacting with either of the first and second spaced apart panes when the insulated glass assembly experiences an external impact.

5. The insulated glass assembly of claim 1, wherein the first spring element and the second spring element are configured to prevent the internal divider from contacting with either of the first and second spaced apart panes when the insulated glass assembly experiences fluctuations in the space between the first and second spaced apart panes due to changing environmental conditions.

6. The insulated glass assembly of claim 1, wherein the internal divider is formed from a material low in thermal conductivity to limit heat transfer between the first and second spaced apart panes.

7. The insulated glass assembly of claim 1, wherein the first spring element is formed from low thermal conductivity materials to limit heat transfer between the first and second spaced apart panes.

8. The insulated glass assembly of claim 1, wherein the first spring element and the second spring element are secured to opposing sides of the internal divider.

9. The insulated glass assembly of claim 1, wherein the first spring element is formed from a polymeric material.

10. The insulated glass assembly of claim 1, wherein the first spring element is formed from a transparent material.

11. The insulated glass assembly of claim 1, wherein the first spring element is formed from an outgassing resistant material.

12. The insulated glass assembly of claim 1, wherein the first and second panes are panes of transparent sheet material.

13. The insulated glass assembly of claim 1, wherein the insulated glass assembly is a component of a door.

14. The insulated glass assembly of claim 1, wherein the insulated glass assembly is a component of a window.

15. The insulated glass assembly of claim 1, wherein the insulated glass assembly is a component of a window sash.

16. The insulated glass assembly of claim 1, wherein the divider defines a top and a bottom opposite the top, and further wherein first spring element extends from the first face such that the first spring element does not project beyond the top of the divider or beyond the bottom of the divider.

17. An insulated glass assembly comprising:

a first pane of translucent, obscure, or transparent sheet material and having a perimeter extending around a central region;

a second pane of translucent, obscure, or transparent sheet material spaced apart from the first pane of sheet material and having a perimeter extending around a central region;

a perimeter spacer positioned between the first and second panes and extending around the perimeters of the panes and defining two pairs of opposite sides of the glass assembly;

an internal divider extending across the central regions of the panes and having a top and a bottom opposite the top, the internal divider being distinct from the perimeter spacer and being disposed between the first and second spaced apart panes, wherein the internal divider is spaced from the first pane of sheet material to form a first gap therebetween, and the internal divider is spaced from the second pane of sheet material to form a second gap therebetween;

a first spring element configured as a leaf spring positioned within the first gap between the internal divider and the first pane of sheet material, the first spring element not projecting beyond the top or bottom of the divider, the first spring element being in a compressed state to bias the internal divider away from the first pane of sheet material; and a second spring element configured as a leaf spring positioned within the second gap between the internal divider and the second pane of sheet material and not projecting beyond the top or bottom of the divider, the second spring element being in a compressed state to bias the internal divider away from the second pane of sheet material, such that the first spring element and the second spring element combine to bias the internal divider against contact with either of the first and second spaced apart panes during gap fluctuations between the first and second spaced apart panes, wherein the first spring element has a leaf spring configuration selected from the following:

a folded polymeric sheet material, with one side of the sheet material secured to the internal divider;

a folded sheet material, with one side of the sheet material secured to the internal divider, with the free side of the folded sheet material being curved such that a convex surface of the spring element contacts the first pane;

a twice-folded sheet material forming a Z-shape, with one side of the sheet material secured to the internal divider and a parallel side of the Z-shape in contact with the first pane;

a twice-folded sheet material forming an M-shape, with one side of the sheet material secured to the internal divider and a parallel side of the M-shape in contact with the first pane, such that the center of the M-shape provides a continuous curve;

a 3-fold sheet material forming an M-shape, with one side of the sheet material secured to the internal divider and the other parallel side of the M-shape in contact with the first pane, such that a center of the M-shape of the leaf spring element includes a distinct fold;

a sheet of material forming a C-shape, with opposing ends of the sheet material secured to the internal divider and a curved side of the C-shape in contact with the first pane;

a sheet of material forming an extended C-shape, with opposing ends of the sheet material secured to the internal divider and extending about perpendicular to the internal divider with a curved side of the C-shape in contact with the first pane; or a sheet of material forming a C-shape, with opposing ends of the sheet material pointing toward one another and secured to the internal divider and extending about perpendicular to the internal divider with the curved side of the C-shape in contact with the first pane.

* * * * *